US006488240B1

(12) United States Patent
Brooker et al.

(10) Patent No.: US 6,488,240 B1
(45) Date of Patent: Dec. 3, 2002

(54) HOSE HANGER APPARATUS

(75) Inventors: Steven F. Brooker, Marietta, OH (US); Michael R. McBride, Davisville, WV (US)

(73) Assignee: Ames True Temper, Inc., Camp Hill, PA (US)

( * ) Notice: Subject to any disclaimer, the term of this patent is extended or adjusted under 35 U.S.C. 154(b) by 0 days.

(21) Appl. No.: 10/066,700

(22) Filed: Feb. 6, 2002

(51) Int. Cl.[7] ..... A47G 29/00
(52) U.S. Cl. ..... 248/89; D8/356; 137/355.16
(58) Field of Search ..... 248/75, 79, 80, 248/81, 89, 90, 91, 92, 93; 137/355.16, 355.26; D8/356

(56) References Cited

U.S. PATENT DOCUMENTS

| | | | | |
|---|---|---|---|---|
| 1,284,022 A | | 11/1918 | Wright | |
| 4,253,716 A | | 3/1981 | Turner, Jr. | |
| 4,436,267 A | | 3/1984 | Eads et al. | 248/75 |
| 4,550,892 A | * | 11/1985 | Whitley | 248/90 |
| 4,836,479 A | | 6/1989 | Adams | 248/89 |
| D322,746 S | | 12/1991 | Sassano | D8/356 |
| 5,238,105 A | | 8/1993 | Smiley | 248/79 X |
| 5,419,362 A | | 5/1995 | Blackaby | 137/355.16 |
| 5,699,987 A | | 12/1997 | Romaneschi et al. | 248/89 |
| D408,270 S | | 4/1999 | Tisbo et al. | D8/356 |
| 6,079,675 A | * | 6/2000 | Hsu | 248/68.1 |

* cited by examiner

*Primary Examiner*—Ramon O. Ramirez
(74) *Attorney, Agent, or Firm*—Pillsbury Winthrop LLP

(57) ABSTRACT

A hose hanger apparatus includes a hose supporting body and a hose retainer. The hose supporting body has mounting structure to enable the hose supporting body to be mounted to a wall in an operative position in which a hose supporting surface faces generally upwardly and extends outwardly from the wall. The hose retainer is movable between retaining and releasing positions. In its retaining position, the hose retainer extends upwardly adjacent the hose supporting surface in spaced relation from the wall to inhibit the upper portion of the coiled hose from moving off the hose supporting surface without first raising the hose to a height sufficient to vertically clear the hose retainer. In its releasing position, the hose can be removed from or mounted onto the hose supporting surface without the need for first raising the hose to a height sufficient to vertically clear the hose retainer.

16 Claims, 8 Drawing Sheets

HOSE HANGER APPARATUS

FIELD OF THE INVENTION

The invention is generally related to lawn and garden equipment and more particularly related to apparatuses for storing garden hoses.

BACKGROUND OF THE INVENTION

Hoses are frequently used for lawn care, gardening, and similar activities, but can be difficult and inconvenient to use. Each time a homeowner uses a hose, for example, he or she typically takes the hose out of storage, connects it to a faucet, and pulls the free end of the hose to the location where water is needed. When the homeowner is finished using the hose, the hose is frequently wound into a coil and carried to a basement or garage for storage. Hoses are long, heavy and cumbersome to handle. Coiled hoses in particular are difficult to lift and move because each loop of a coiled hose must be captured before the hose is moved to reduce the chance the hose will become uncoiled or tangled while being lifted or moved.

It is often easier to handle a hose if it is hung during storage as opposed to laying the coiled hose on a flat surface. It is convenient to hang a hose on a wall-mounted fixture and such fixtures are know in the art. These fixtures make using a hose easier because they can be easily mounted on a wall of a house or garage and are in fact often mounted next to the faucet. Although these fixtures provide a way to hang a hose in a convenient location, they do not simplify the problem of handling the coiled hose.

An example of a wall-mounted fixture is illustrated in U.S. Pat. No. Des. 408,270. In the '270 patent the fixture includes a body having a horizontally extending support surface and a vertically extending wall structure that extends upwardly from the horizontal support surface. When the fixture of the '270 patent is mounted on a wall of a building, the horizontal support surface extends outwardly from the building wall and the vertically extending wall structure is spaced from the building wall. A coiled hose is supported on the horizontal support surface between the building wall and the vertical wall structure of the fixture of the '270 patent. The vertically extending wall structure keeps the coiled hose from sliding off of the horizontal support surface during storage, but it also complicates the problem of coiling the hose around the fixture for storage and removing the hose from the fixture for use. For example, to remove a coiled hose from the fixture, the hose must be lifted off the support surface and over the vertically extending wall structure of the fixture.

SUMMARY OF THE INVENTION

The present invention provides a hose hanger apparatus for supporting a length of hose arranged in a coil adjacent a generally vertical support surface, such as a building wall or a fence. The apparatus includes a hose supporting body and a. hose retainer. The hose supporting body has a hose supporting surface and mounting structure constructed and arranged to enable the hose supporting body to be mounted to the generally vertical support surface in an operative position in which the hose supporting surface faces generally upwardly and extends generally outwardly away from the generally vertical support surface. The hose supporting body is constructed and arranged to enable the hose to be supported thereon when the hose supporting body is mounted in its operative position with the length of hose being arranged in a coil and the hose supporting surface supporting an upper portion of the coil. The hose retainer is movable between (a) a hose retaining position wherein, when the hose supporting body is in its operative position with the hose being arranged in a coil and supported thereon, the hose retainer extends upwardly adjacent the hose supporting surface and in spaced apart relation from the generally vertical support surface to inhibit the upper portion of the coil supported on the hose supporting surface from moving in a direction away from the generally vertical support surface off the hose supporting surface without first raising the hose to a height sufficient to vertically clear the hose retainer, and (b) a hose releasing position wherein, when the hose supporting body is in its operative position with the hose being arranged in a coil and supported thereon, the hose retainer is moved out of the hose retaining position to enable the hose to be removed from the hose supporting surface without the need for first raising the hose to a height sufficient to vertically clear the hose retainer and to enable the hose to be mounted onto the hose supporting body with the hose being arranged in a coil and the hose supporting surface supporting an upper portion of the coil without the need for first raising the unsupported hose to a height sufficient to vertically clear the hose retainer.

The hose hanger apparatus may optionally include a pair of side walls that extend downwardly away from the hose supporting surface and define an interior storage compartment suitable for storing articles to be used with the hose and a storage front panel movable between open and closed positions for controlling access to the interior storage compartment to facilitate storage and retrieval of the articles.

Other aspects, features and advantages of the present invention will become apparent from the following detailed description, the accompanying drawings, and the appended claims.

DETAILED DESCRIPTION

Figure 1:
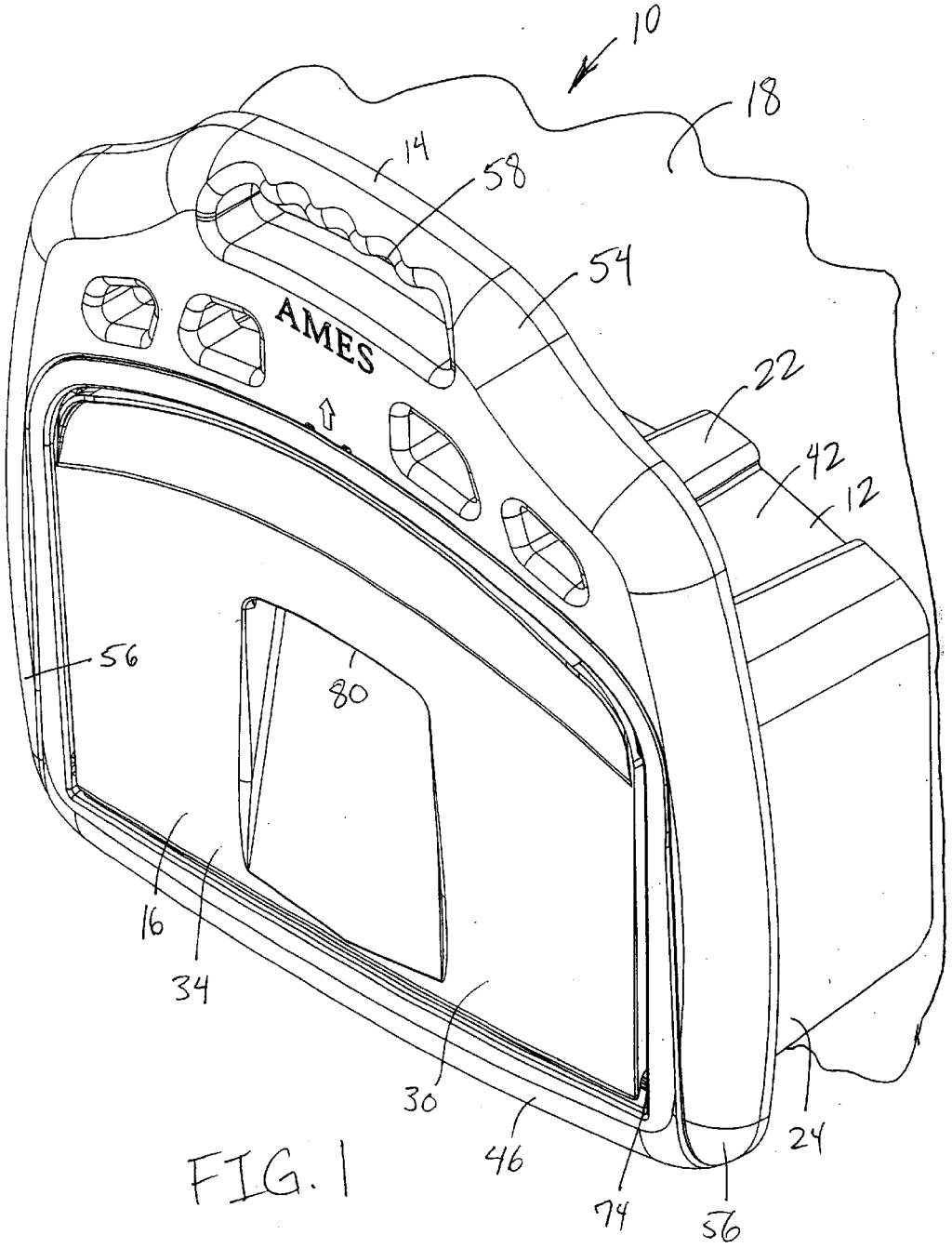
FIG. 1 is a perspective view of a hose hanger apparatus constructed according to the principles of the present invention.
Figure 2:
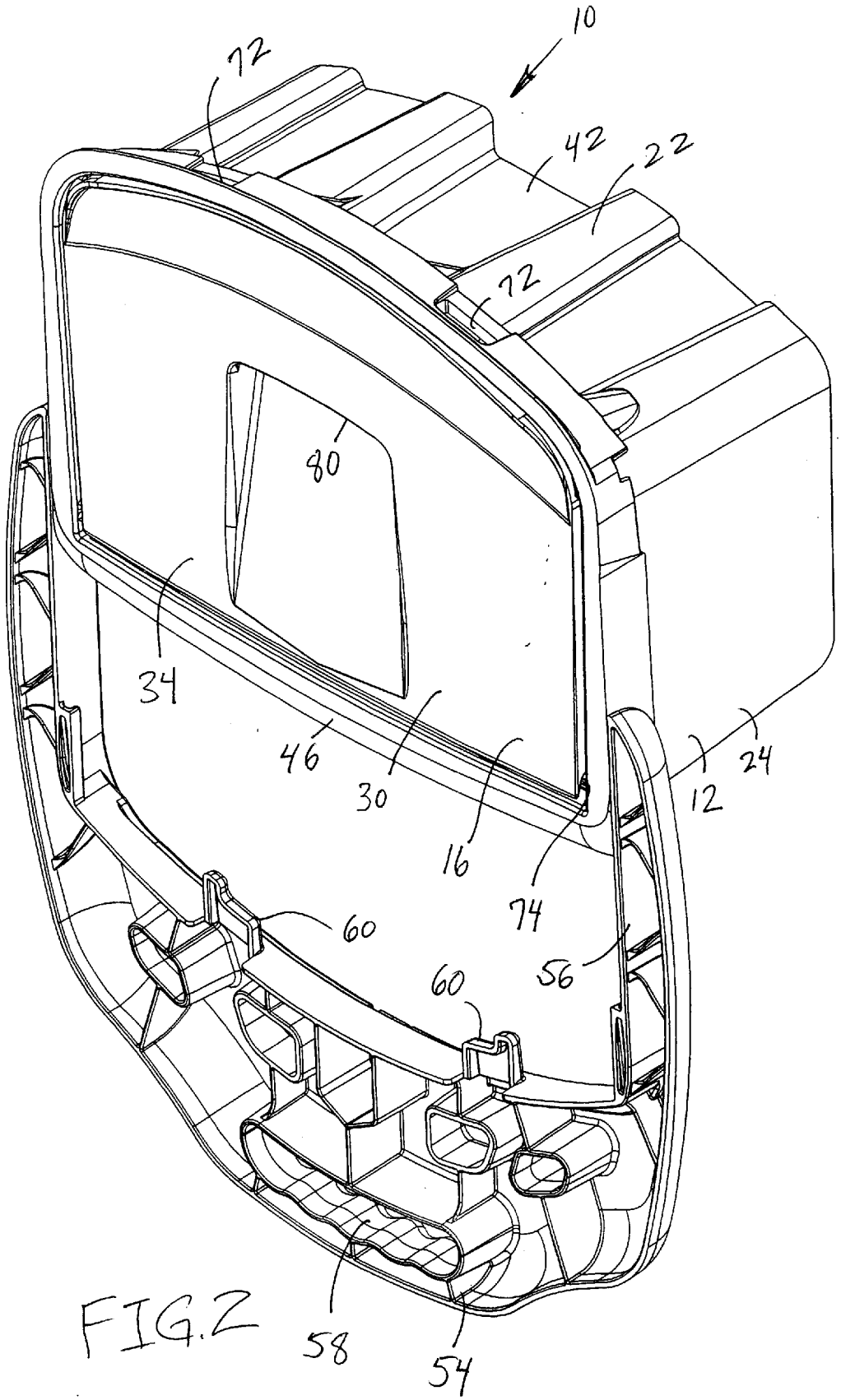
FIG. 2 is a view similar to FIG. 1 except showing hose retainer of the hose hanger apparatus in its hose releasing position.
Figure 3:
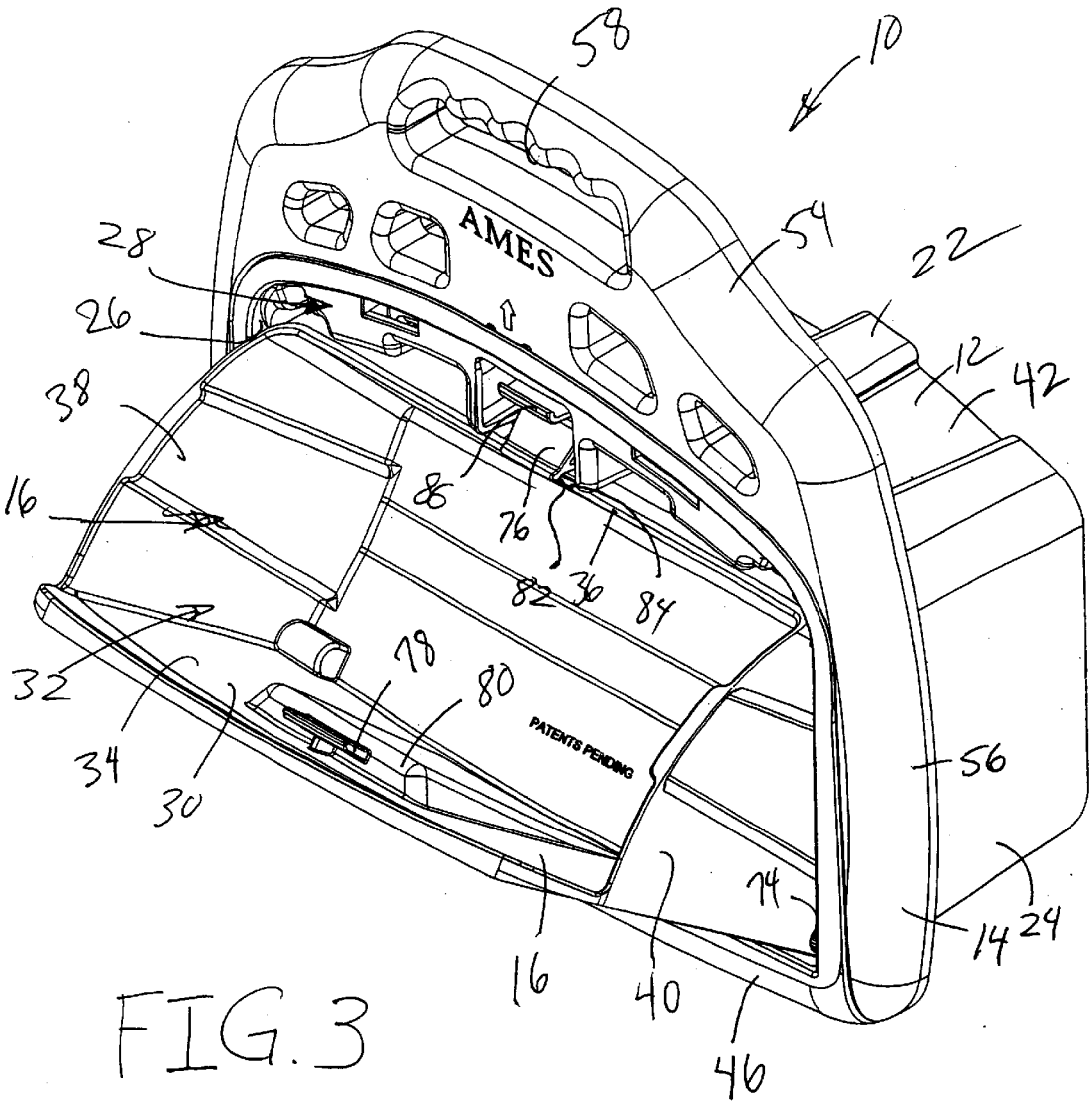
FIG. 3 is a view similar to FIG. 1 except showing a storage bin of the hose hanger apparatus in its open position.

An example of a hose hanger apparatus 10 constructed according to the principles of the present invention is shown in FIGS. 1–3. The hose hanger apparatus 10 includes a hose supporting body 12, a hose retainer 14 and a storage bin 16. The hose hanger apparatus 10 can be used to store a hose and to store and transport articles.

The general operation of the hose hanger apparatus 10 to store a hose can be understood from FIGS. 1 and 2. The hose hanger apparatus 10 may be mounted in an operative position on a vertical support surface or wall 18 (shown in FIG. 1 only) to support a length of coiled hose adjacent the generally vertical support surface 18. The wall 18 may represent an exterior wall of a house or a garage, a fence or other appropriate structure. The hose supporting body 12 includes a horizontal support surface 22 and mounting structure 48. The mounting structure 48 is constructed and arranged to enable the hose supporting body 12 to be mounted to the generally vertical support surface 18 in its operative position with the horizontal support surface 22 facing generally upwardly and extending generally outwardly away from the generally vertical support surface 18. The hose supporting body 12 is constructed and arranged to enable the hose to be supported thereon when the hose supporting body 12 is mounted in its operative position with the length of hose arranged in a coil and the hose supporting surface 22 supporting an upper portion of the coil.

The hose retainer 14 is movable between a hose retaining position (see FIG. 1, for example) and a hose releasing position (see FIG. 2, for example). When the hose supporting body 12 is mounted in an operative position on the wall 18 and the hose retainer 14 is in its hose retaining position, the hose retainer 14 extends upwardly adjacent a hose supporting surface 22 (best seen in FIG. 1) on the hose supporting body 12 and in spaced apart relation from the generally vertical support surface 18.

When a hose is arranged in a coil and supported on the hose supporting surface 22 while the hose retainer 14 is in its hose retaining position, the hose retainer 14 inhibits the upper portion of the coil supported on the hose supporting surface 22 from moving in a direction away from the generally vertical support surface 18 off the hose supporting surface 22 without first raising the hose to a height sufficient to vertically clear the hose retainer 14. When the hose supporting body 12 is mounted in its operative position and the hose retainer 14 is moved into its hose releasing position, the hose retainer 14 is positioned to enable the hose to be removed from the hose supporting surface 22 without the need for first raising the hose to a height sufficient to vertically clear the hose retainer 14. Specifically, the hose can be removed from the hose supporting surface 22 by sliding the hose generally horizontally in a direction away from the wall 18. Also, the user can simply walk away from the apparatus 10 with the free end of the hose in hand. The hose will easily pay out from the apparatus 10 and the user does not need to be concerned with the hose retainer 14 interfering with the pay out of the hose. This also enables the hose to be mounted onto the hose supporting body 12 (with the hose arranged in a coil and the hose supporting surface 22 supporting an upper portion of the coil) without the need to first raise the unsupported hose to a height sufficient to vertically clear the hose retainer 14.

The general operation of the hose hanger apparatus 10 to store articles can be understood from FIGS. 1 and 3. The hose supporting body 12 includes a pair of side walls 24, 26 that extend downwardly away from the hose supporting surface 22 and define an interior storage compartment 28 suitable for storing articles (not shown, but may include a hose nozzle, a sponge, and so on) to be used with the hose. A front panel 30 is movable between an open position (see FIG. 3, for example) and a closed position (see FIG. 1, for example) to control access to the interior storage compartment 28 to facilitate storage and retrieval of the hose related articles. The example hose hanger apparatus 10 includes a storage bin 16 which is stored in the storage compartment 28 and which may used to hold articles.

The storage bin 16 defines a storage space 32 that is generally bounded by four peripheral walls 34, 36, 38, 40. The peripheral wall 34 defines the front panel 30. The storage bin 16 is movably mounted between the side walls 24, 26 for movement between an open position (see FIG. 3, for example) and a closed position (see FIG. 1, for example). When the storage bin 16 is in its open position, the front panel 30 is in its open position and the storage space 32 is accessible so that articles can be moved in and out of the storage space 32. When the storage bin 16 is in its closed position, the front panel 30 is in its closed position and the storage bin 16 is disposed between the side walls 24, 26.

The storage bin 16 is removably mounted to the hose supporting body 12 to allow the storage bin 16 to be removed from the hose supporting body 12 and carried. The storage bin 16 is constructed and arranged to be supported in a free standing manner in an upright position on a support surface (see FIG. 8, for example), as will be discussed below.

The hose supporting body 12, the hose retainer 14 and the storage bin 16 of the example hose hanger apparatus 10 are each constructed of a molded plastic material of suitable strength, although any appropriate material, such as a stamped or cast metal material, for example, can be used for their construction.

Figure 4:
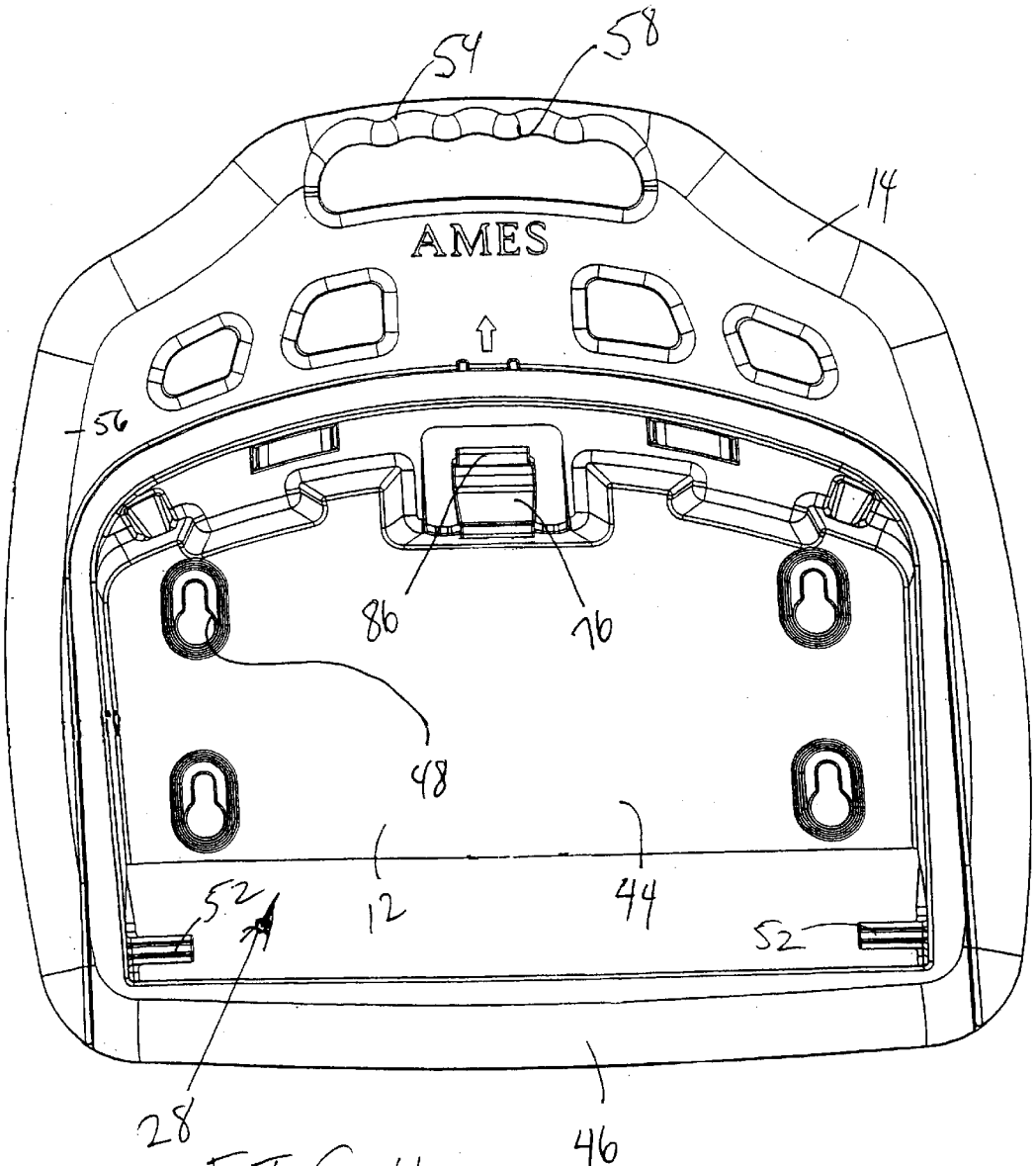
FIG. 4 is a front elevational view of the hose hanger apparatus with the storage bin thereof removed and not shown.
Figure 5:
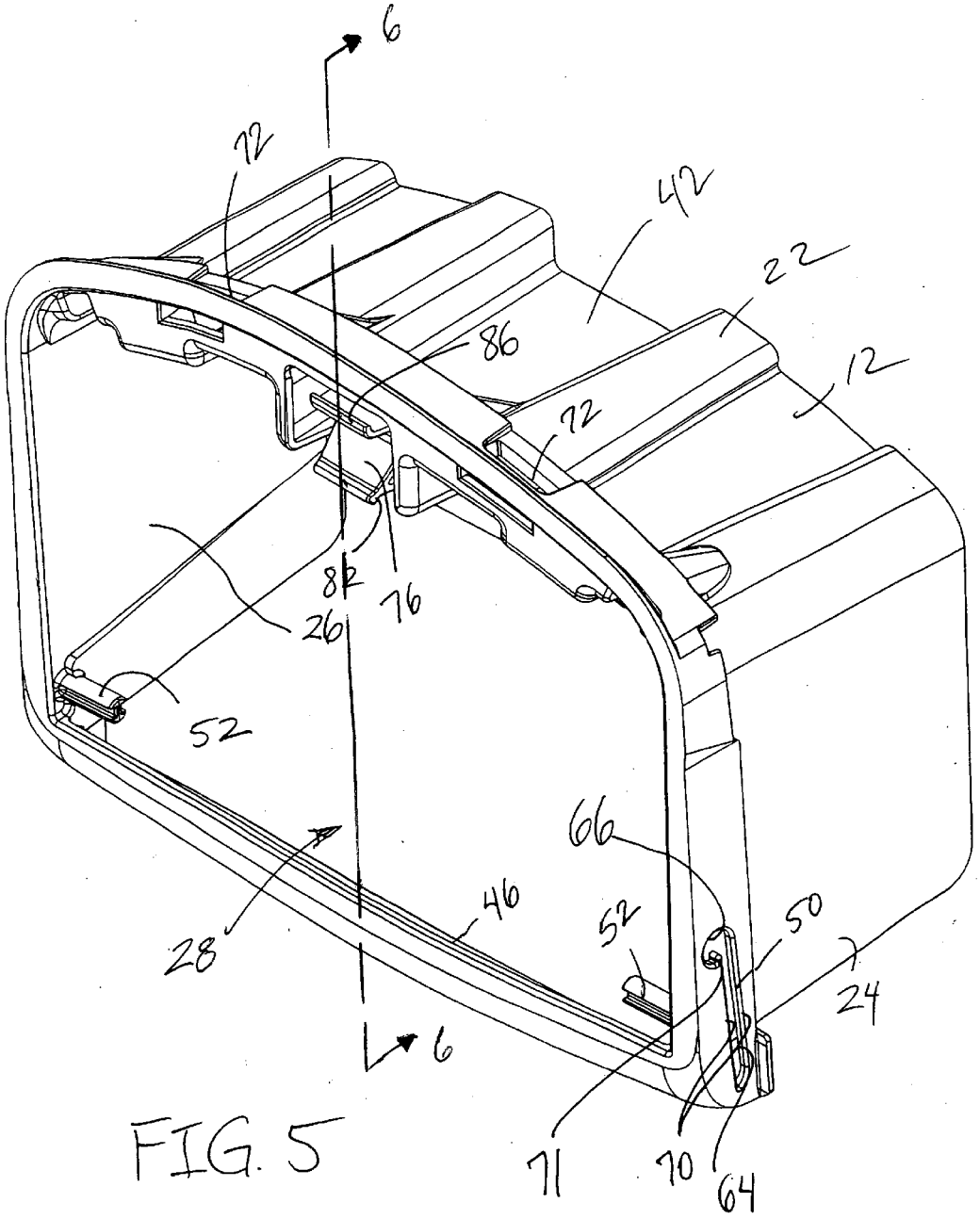
FIG. 5 is a perspective view showing a hose supporting body of the hose hanger apparatus in isolation.
Figure 6:
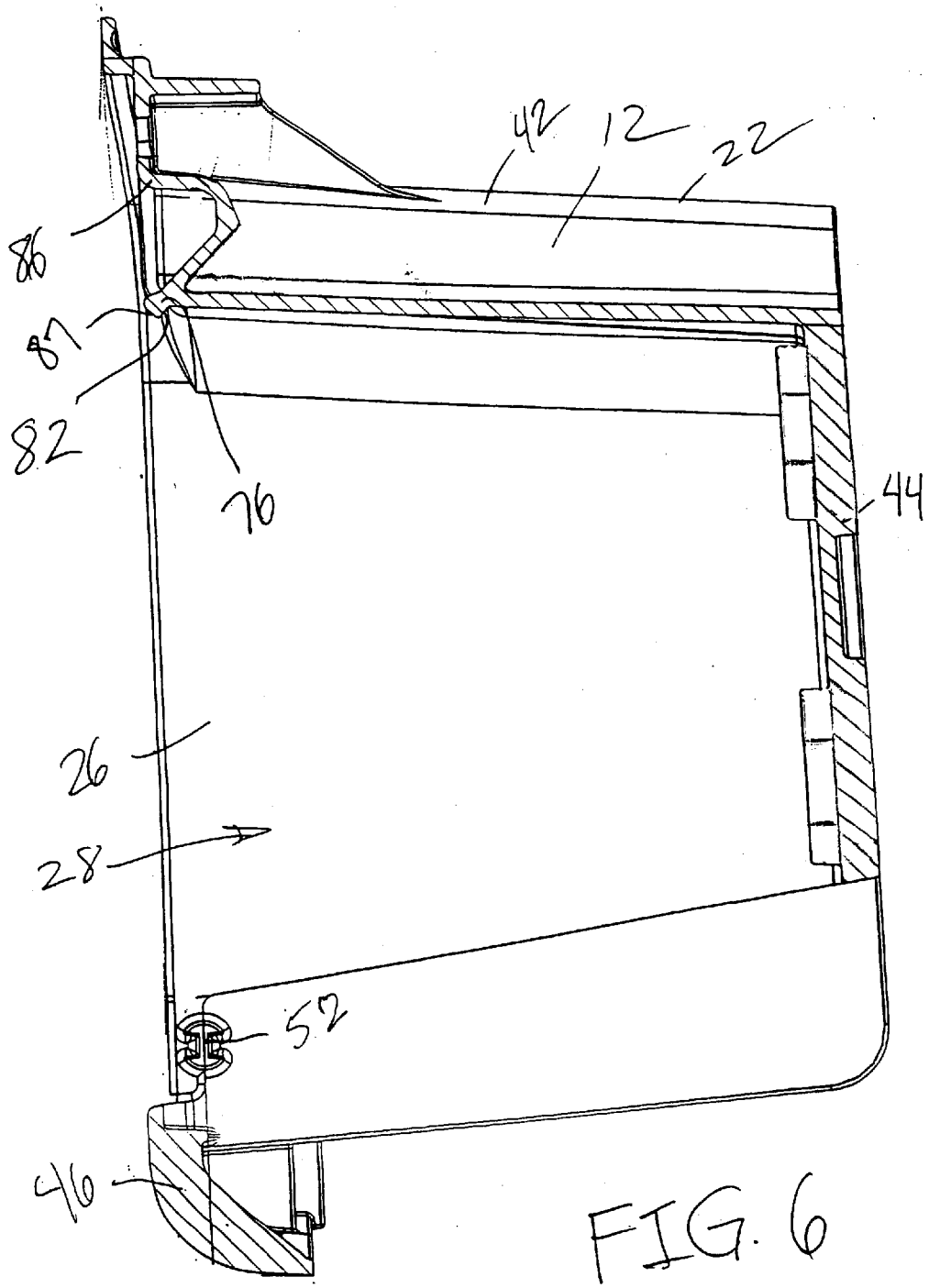
FIG. 6 is a cross sectional view taken through the line 6—6 as indicated in FIG. 5.

The structural details of the construction of the hose supporting body 12 can be best understood from FIGS. 4–6. The hose supporting body 12 is a one-piece integral plastic structure that is shaped to form an upper wall 42, the side walls 24, 26, and a back wall 44. An elongated portion 46 of the hose supporting body 12 extends between the side walls 24, 26. The back wall 44 includes mounting structure in the form of a plurality of openings 48 (see FIG. 4) to enable the hose supporting body 12 to be mounted in an operative position to the wall 18 using a plurality of headed fasteners such as nails or screws.

A pair of elongated slots 50 (only one is visible in the figures) are formed on opposite sides of the hose supporting body 12. The slots 50 are operable (as explained below) to guide the hose retainer 14 for movement between its hose releasing position and its hose retaining position. A pair of pivot pins 52 are integrally formed on the side walls 24, 26. The pins 52 are operable to support the storage bin 16 for movement between open and closed positions.

Figure 7:
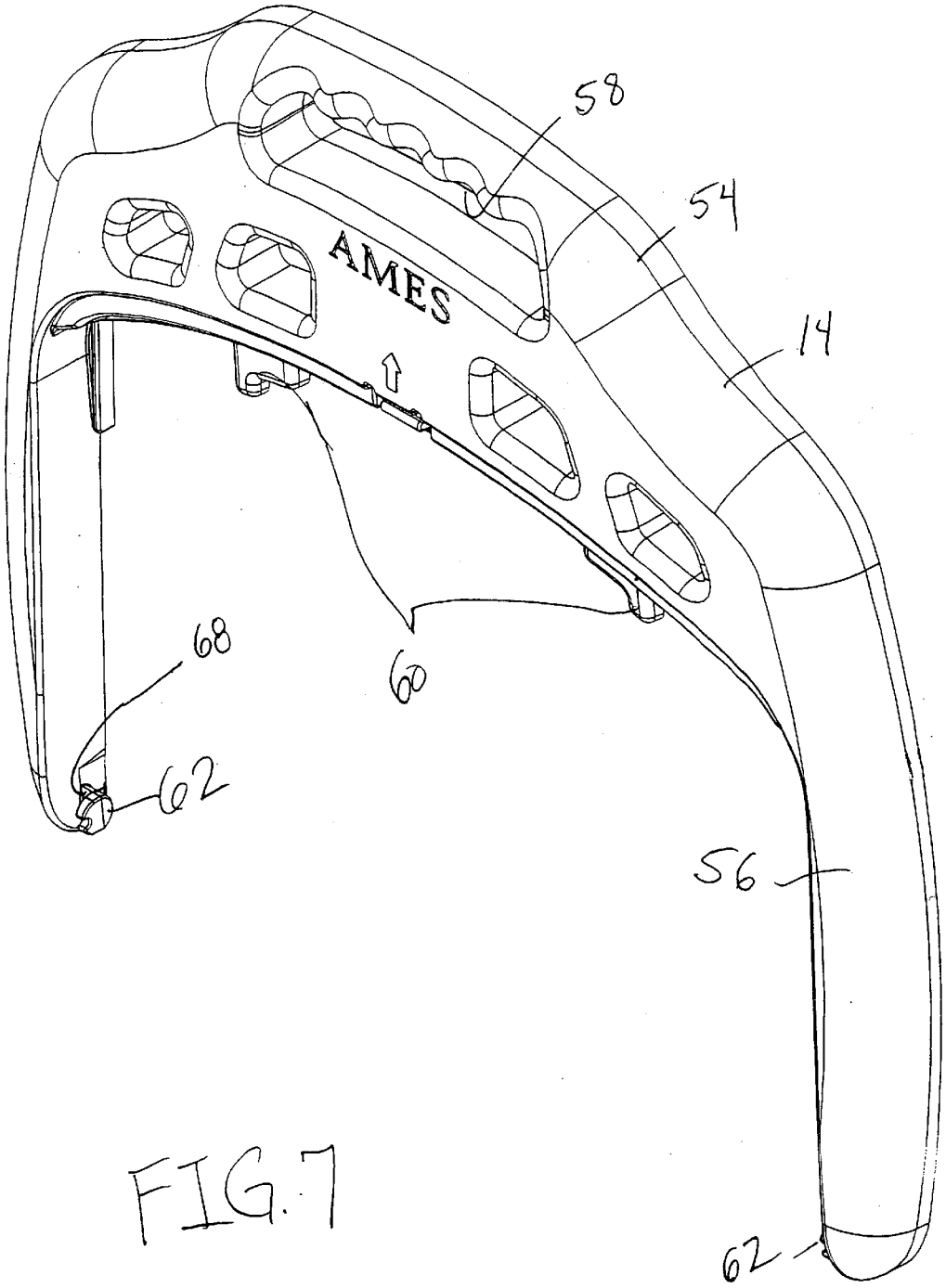
FIG. 7 is a perspective view showing the hose retainer of the hose hanger apparatus in isolation.

The structural detail of the hose retainer 14 can be best appreciated from FIG. 7. The hose retainer 14 is generally U-shaped and includes a central portion 54 and a pair of arms 56 extending integrally downwardly from the central portion 54. The central portion 54 includes a handle 58 and a pair of tabs 60. A pivot pin 62 (see FIG. 7) is formed on the end of each arm 56.

The hose retainer 14 is pivotally connected to the hose supporting body 12 for pivotal movement between the hose retaining and hose releasing positions by inserting each pivot pin 62 on the hose retainer 14 into a respective elongated slot 50 on the hose supporting body 12. The hose retainer 14 remains connected with the hose supporting body 12 when it is in its hose retaining and the hose releasing positions and when it is moving between these two positions.

The connection between the pins 62 and the elongated slot 50 forms a shifting pivotal connection. Each slot 50 includes a relatively narrow lower portion 64 and an essentially circular upper portion 66. Each pin 62 includes a notch 68 on the side thereof (best seen in FIG. 7). When a pin 62 is in the narrow lower portion 64 of an elongated slot 50, the wall portions 70 surrounding the slot 50 are disposed within the notch 68. When the wall portions 70 are in the notch 68, the pins 62 can slide vertically within the slot 50 (so that the hose retainer 14 can move essentially vertically with respect to the hose supporting body 12), but the engagement of the walls 70 with the notch 68 prevents pivotal movement of the hose retainer 14 with respect to the hose supporting body 12. When each pin 62 is within the circular upper portion 66, however, the hose retainer 14 is able to pivot with respect to the hose supporting body 12. A lip 71 on the slot 50 prevents the inverted hose retainer 14 from sliding down the narrow portion 64 of the slot 50. Thus, the lip 71 assures that the hose retainer 14 only enters the portion 64 of the slot for vertical sliding movement with respect to the hose supporting body when the hose retainer is oriented such that the arms thereof extend downwardly.

The hose retainer 14 and the hose supporting body 12 have cooperating locking structure for releasably locking the hose retainer 14 in its hose retaining position. The cooperating locking structure is disengageable to release the hose retainer for movement to its hose releasing position.

The cooperating locking structure is provided by one or more tabs 60 carried on the hose retainer 14 and a tab receiving space or opening 72 on the hose supporting body 12 for each tab 60. When the hose retainer 14 is in its hose retaining position, each pin 62 is at the bottom of the narrow lower portion 64 of the associated elongated slot 50 and each tab 60 is in its respective tab receiving space 72. The engagement of tabs 60 with the tab receiving spaces 72 prevents the hose retainer 14 from pivoting with its hose retaining position toward its hose releasing position until the tabs 60 are disengaged from the tab receiving spaces 72.

Thus, to move the hose retainer 14 from its hose retaining position to its hose releasing position, the hose retainer 14 is moved generally upwardly in a shifting manner to an intermediate position (not shown) to disengage the cooperating locking structure 60, 72. Then, the hose retainer 14 is pivoted downwardly to its hose releasing position. The intermediate position is reached when the hose retainer 14 is pulled upwardly far enough to position the pins 62 in the circular upper portions 66 of the slots 50, and before any pivotal movement of the hose retainer 14 with respect to the hose supporting body 12 has commenced. To move the hose retainer 14 from its hose releasing position to its hose retaining position, the hose retainer 14 is pivoted upwardly to its intermediate position and then the hose retainer is shifted downwardly to its hose retaining position. As the hose retainer 14 slides downwardly, the tabs 60 re-enter their respective tab receiving spaces 72 to re-engage the cooperating locking structure 60, 72.

Each tab 60 extends generally downwardly from the hose retainer 14 when the hose supporting body 12 is in its operative position and the hose retainer 14 is in either its hose retaining position or its intermediate position. Each tab receiving space 72 faces generally upwardly when the hose supporting body 12 is in its operative position. The tabs 60 are engaged with the spaces 72 by moving the hose retainer 14 from its intermediate position to its hose retaining position. The tabs 60 are disengageable from the spaces by moving the hose retainer 14 from its hose retaining position back to its intermediate position.

Any suitable construction may be used for the cooperating locking structure to secure the hose retainer 14 in its hose retaining position in place of tabs 60 and spaces 72. For example, a snap-fit lock, a detent system, or latches could be used. Further, any suitable construction may be used to connect the hose retainer 14 for movement between the hose releasing and hose retaining positions. For example, a linkage could be used in place of the shifting pivotal connection.

Figure 8:
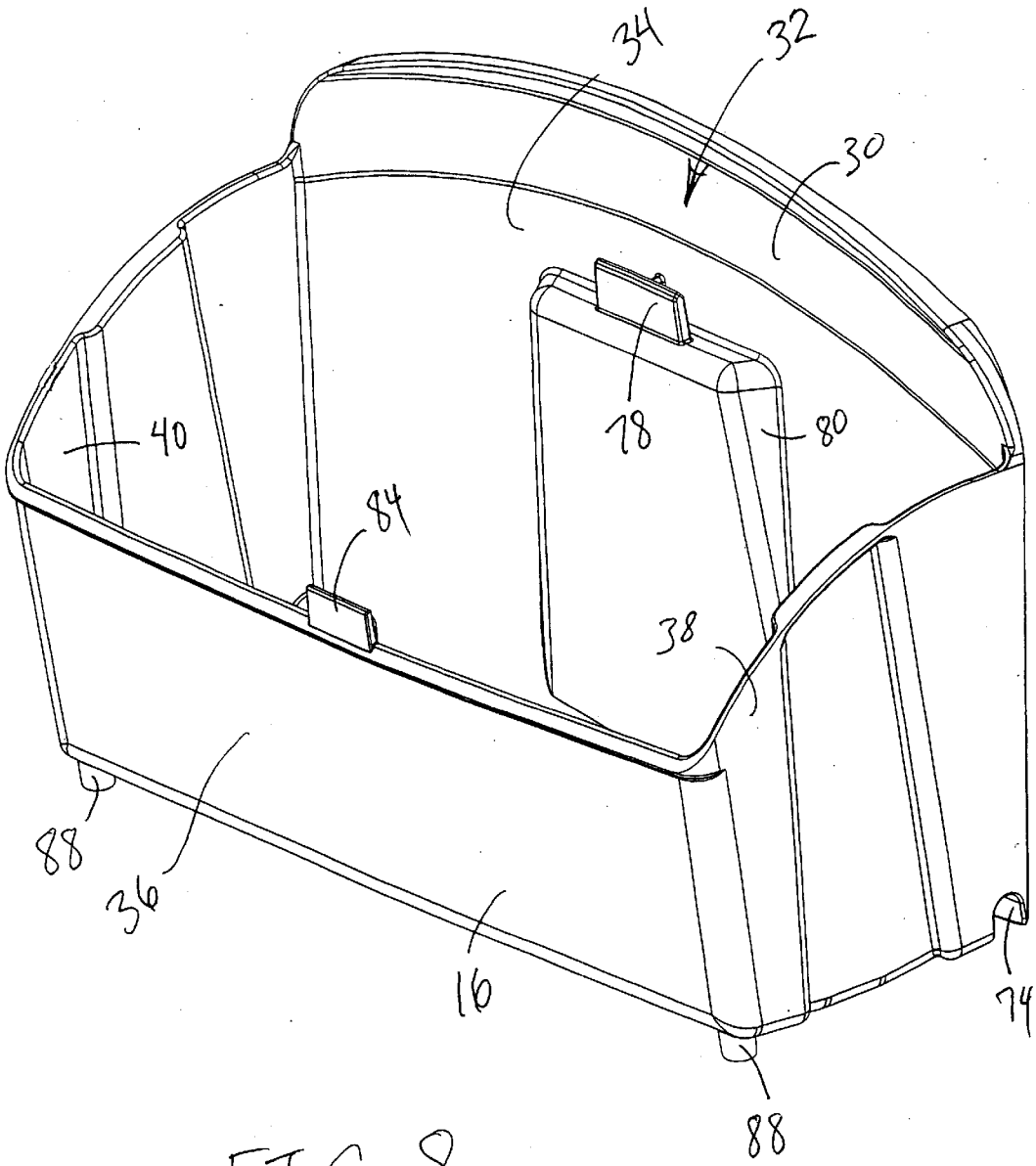
FIG. 8 is a perspective view showing a storage bin of the hose hanger apparatus in isolation.

The structural detail of the storage bin 16 is best appreciated from FIG. 8. The storage bin 16 includes a pair of arcuate recesses 74 formed on opposite sides thereof. The storage bin 16 is pivotally mounted between the side walls 24, 26 of the hose supporting body 12 for pivotal movement between its open and closed positions by placing each arcuate recess 74 in overlying relation to a respective pivot pin 52 formed on the hose supporting body 12. The storage bin 16 and the hose supporting body 12 have cooperating locking structure operable to releasably lock the storage bin 16 in its closed position. The cooperating locking structure is disengageable to release the storage bin 16 for movement to its open position. The cooperating locking structure is provided in the form of a resilient hook structure 76 (see, for example, FIG. 5) integrally formed on the hose supporting body 12 (see, for example, FIG. 5) and of a forward tab 78 integrally formed on the storage bin 16 (see, for example, FIG. 8).

The front panel 30 of the storage bin 16 includes a handle 80 to facilitate opening and closing the storage bin 16. This handle 80 optionally facilitates carrying the storage bin 16 when the storage bin is removed from the hose supporting body 12. When the storage bin 16 is in its closed position, the tab 78 on the storage bin 16 engages a locking surface 82 on the hook structure 76 which holds the storage bin in its closed position. It can also be appreciated that when there are articles stored in the storage bin 16, the weight of the articles tends to keep the storage bin 16 in its closed position as well.

To move the storage bin 16 to its open position, the operator pulls the storage bin 16 in its opening direction using the handle 80. The hook structure 76 flexes to disengage the tab 78 from the locking surface 82. The storage bin 16 pivots forwardly until a rearward tab 84 integrally formed on the storage bin 16 contacts the locking surface 82 to prevent further pivotal movement of the storage bin 16.

The cooperating locking structure 76, 82 is disengageable from the storage bin 16 to allow removal of the storage bin 16 from the storage compartment 28 of the hose supporting body 12. Specifically, the hook structure 76 includes a manually engageable flange 86 to allow the operator to manually move the hook structure 76 out of engagement with the rear tab 84 of storage bin 16 to release the storage bin from the hose supporting body 12. To release the storage bin 16, the user moves the flange 86 to move the hook structure 76 out of engagement with the rear tab 84 which allows the storage bin 16 to pivot further in its opening direction with respect to the hose supporting body 12. The user then lifts the storage bin 16 off of the pivot pins 52. The storage bin 16 can then be carried away from the hose supporting body 12 for use as a separate container. The storage bin 16 is reinstalled in the hose supporting body 12 in essentially the reverse manner. That is, the recesses 74 on the storage bin 16 are placed on the pins 52 and the storage bin 16 is pivoted in its closing direction with respect to the hose supporting body 12. The hook structure 76 includes an angled front surface 87 (best seen in FIG. 6) that allows the movement of the rear tab 84 moving in the closing direction to move the hook structure 76 in its releasing position to allow the rear tab 84 to move past the hook structure 76. This alleviates the user from manually moving the hook structure 76 out of the travel path of the rear tab 84 when the storage bin 16 is being reinstalled in the hose supporting body 12.

The storage bin 16 includes a pair of rear feet 88 that stabily support the storage bin 16 on a horizontal surface in a freestanding manner and allow the storage bin 16 to be used as a storage container separate from the hose supporting body 12. The storage bin 16 can be used to store and transport tools, or can be used to contain a liquid such as soapy water.

Operation

The hose hanger apparatus 10 can be used in many ways to make working with and storing a hose easy. To store a hose on the hose supporting body 12, the user can coil the hose first and then place the coiled hose on the hose hanger apparatus 10 when the hose retainer 14 in its hose releasing position. By placing the hose retainer 14 in its hose releasing position, there are no obstructions in front of the hose supporting surface 22 that impede placement of the hose on the surface 22. Alternatively, the user can store the hose in the hose hanger apparatus 10 by winding the uncoiled hose around the hose supporting body 12. When this method is used, the user may prefer to keep the hose retainer 14 in its hose retaining position as the hose is being coiled around the hose supporting body 12 to keep the coils on the hose supporting surface 22.

To remove the coiled hose from the hose supporting body 12 for use, the user may move the hose retainer 14 to its hose releasing position before removing the coiled hose from the hose supporting body 12. When the user removes the coiled hose from or places the coiled hose on the hose supporting body 12 with the hose retainer 14 in its hose releasing position, the user is able to remove the coiled hose from the hose supporting body 12 without the need for lifting the coiled hose over the hose retainer 14. This has several advantages. For example, when removing a coiled hose from the hose supporting body 12, the sliding movement of the hose assures that the hose user removes all of the coils of the hose from the hose supporting body 12 when removing the hose from the hose hanger apparatus 10. If the user had to lift the hose to a height sufficient to clear the hose retainer 14, the user may not grab all of the coils. If one or more coils are missed when the hose is lifted, the hose may start to uncoil and/or the coils may become of unequal size. If the user continues to lift and move only some of the coils, the hose can become tangled. If the user returns the hose to the hose supporting surface of the hose supporting body 12, and re-attempts to pick up all the coils at once, the hose can become unwieldy and may start to unravel. The user can easily remove the hose from the hose supporting body 12 when the hose retainer 14 is it its hose releasing position by sliding the hose horizontally away from the wall 18 and catching the coils as they come of the hose supporting surface 22. An additional advantage, mentioned above, is that the user can simply walk away from the apparatus 10 with the free end of the hose in hand and the hose will easily pay out from the apparatus 10.

To open the storage bin 16, the user pulls on the handle 80 of the front panel 30 which causes the hook structure 76 to flex, releasing the front tab 78 from locking engagement therewith. The storage bin 16 pivots in its opening direction until the rear tab 84 contact the locking surface 82 of the hook structure 76. The user can then place articles in or remove articles from the storage bin 16. The storage bin 16 can be closed by pushing on the front panel 30 to cause the storage bin 16 to pivot in its closing direction. The hook structure 76 flexes to allow the tab 78 to move into locking engagement therewith.

To remove the storage bin 16 from the hose supporting body 12, the user moves the storage bin 16 to its open position as described above and then the user applies pressure to the flange 86 to move the hook structure 76 out of locking engagement with the rear tab 84. The user then pivots the storage bin 16 outwardly from the hose supporting body 12 and lifts the storage bin 16 to lift the recesses 74 off of the pins 52 on hose supporting body 12. The user can then carry the storage bin 16 to a location remote from the hose hanger apparatus 10. The storage bin 16 can be used to store and carry articles and/or can be used as a bucket for containing soapy water, a water/fertilizer mixture or other liquids.

It can be appreciated that the embodiments of the hose hanger apparatus 10 shown and described herein are examples of the invention and are therefore intended only to illustrate the principles of the invention, but not limit the scope of these principles. The present invention is intended to encompass all modifications, alternatives, substitutions, and equivalents within the spirit and scope of the following claims.

What is claimed:

1. A hose hanger apparatus for supporting a length of hose arranged in a coil adjacent a generally vertical support surface, said apparatus comprising:

a hose supporting body having a hose supporting surface and mounting structure constructed and arranged to enable said hose supporting body to be mounted to the generally vertical support surface in an operative position with said hose supporting surface facing generally upwardly and extending generally outwardly away from the generally vertical support surface, said hose supporting body being constructed and arranged to enable the hose to be supported thereon when said hose supporting body is mounted in said operative position with the length of hose being arranged in a coil and said hose supporting surface supporting an upper portion of the coil; and a hose retainer movable between (a) a hose retaining position wherein, when said hose supporting body is in said operative position with the hose being arranged in a coil and supported thereon, said hose retainer extends upwardly adjacent said hose supporting surface and in spaced apart relation from the generally vertical support surface to inhibit the upper portion of the coil supported on said hose supporting surface from moving in a direction away from the generally vertical support surface off said hose supporting surface without first raising the hose to a height sufficient to vertically clear said hose retainer, and (b) a hose releasing position wherein, when said hose supporting body is in said operative position with the hose being arranged in a coil and supported thereon, said hose retainer is moved out of said hose retaining position to enable the hose to be removed from said hose supporting surface without the need for first raising the hose to a height sufficient to vertically clear said hose retainer and to enable the hose to be mounted onto said hose supporting body with the hose being arranged in a coil and said hose supporting surface supporting an upper portion of the coil without the need for first raising the unsupported hose to a height sufficient to vertically clear said hose retainer.

2. A hose hanger apparatus according to claim 1, wherein said hose retainer remains connected with said hose supporting body in said hose retaining and said hose releasing positions thereof.

3. A hose hanger apparatus according to claim 2, wherein said hose retainer is pivotally connected to said hose supporting body for pivotal movement between said hose retaining and hose releasing positions.

4. A hose hanger apparatus according to claim 3, wherein said hose retainer and said hose supporting body have cooperating locking structure for releasably locking said hose retainer in said hose retaining position thereof, said cooperating locking structure being disengageable to release said hose retainer for movement to said hose releasing position thereof.

5. A hose hanger apparatus according to claim 4, wherein the pivotal connection of said hose retainer to said hose supporting body is a shifting pivotal connection constructed and arranged such that (a) to move said hose retainer from said hose retaining position thereof to said hose releasing position thereof, said hose retainer is moved generally upwardly in a shifting manner to an intermediate position to disengage said cooperating locking structure and then said hose retainer is pivoted downwardly to said hose releasing position, and (b) to move said hose retainer from said hose releasing position thereof to said hose retaining position thereof, said hose retainer is pivoted upwardly to said intermediate position and then said hose retainer is shifted downwardly to said hose retaining position to engage said cooperating locking structure.

6. A hose hanger apparatus according to claim 5, wherein said cooperating locking structure comprises (a) a tab carried on said hose retainer and positioned so as to extend generally downwardly therefrom when said hose supporting body is in said operative position and said hose retainer is in said hose retaining position and said intermediate position and (b) a tab receiving space formed on said hose supporting body and positioned so as to face generally upwardly when said hose supporting body is in said operative position, said tab being engageable within said space for releasably locking said hose retainer in said hose retaining position thereof and disengageable from said space to release said hose retainer for movement to said hose releasing position thereof by moving said hose retainer between said hose retaining and intermediate positions.

7. A hose hanger apparatus according to claim 6, wherein said tab comprises a pair of said tabs and wherein said tab receiving space comprises a pair of said tab receiving spaces.

8. A hose hanger apparatus according to claim 5, wherein said shifting pivotal connection is provided by a pair of pivot pins carried on one of said hose retainer and said hose supporting body and a pair of elongated slots carried on the other of said hose retainer and said hose supporting body, said pivot pins being received in said slots for shifting and pivoting movement.

9. A hose hanger apparatus according to claim 8, wherein said pivot pins are carried on said hose retainer and wherein said slots are carried on said hose supporting body.

10. A hose hanger apparatus according to claim 1, wherein said hose supporting body and said hose retainer are formed of molded plastic.

11. A hose hanger apparatus according to claim 1, wherein said hose supporting body further comprises a pair of side walls that extend downwardly away from said hose supporting surface and define an interior storage compartment suitable for storing articles to be used with the hose, said apparatus further comprising a storage front panel movable between open and closed positions for controlling access to said interior storage compartment to facilitate storage and retrieval of said articles.

12. A hose hanger apparatus according to claim 11, further comprising a storage bin defining a storage space bounded by peripheral walls for holding said articles, a portion of said peripheral walls defining said front panel, said storage bin being movably mounted in said storage compartment between said side walls for movement between (1) an open position in which said front panel is in its open position and said storage space is accessible so that articles can be moved in and out of said storage space and (2) a closed position in which said front panel is in its closed position and at least a portion of said storage bin is disposed between said side walls.

13. A hose hanger apparatus according to claim 12, wherein said storage bin and said hose supporting body have cooperating locking structure constructed and arranged to releasably lock said storage bin in said closed position thereof, said cooperating locking structure being disengageable to release said storage bin for movement to said open position thereof.

14. A hose hanger apparatus according to claim 13, wherein said storage bin is removably mounted to said hose supporting body to allow said storage bin to be removed from said hose supporting body and carried as a portable storage bin and wherein said storage bin is constructed and arranged to be supported in a free standing manner in an upright position on a support surface.

15. A hose hanger apparatus according to claim 14, wherein said cooperating locking structure is constructed and arranged to releasably hold said storage bin in said open position thereof, said cooperating locking structure being disengageable from said storage bin to allow removal of said storage bin from said storage compartment of said hose supporting body.

16. A hose hanger apparatus according to claim 15, wherein said storage bin is pivotally mounted to the side walls of said hose supporting body for pivotal movement between said open and closed positions.

* * * * *